United States Patent [19]

Semyanko

[11] 4,395,860

[45] Aug. 2, 1983

[54] SINGLE PLATE BUCKSTAY STIRRUP

[75] Inventor: Andrew Semyanko, Granby, Conn.

[73] Assignee: Combustion Engineering, Inc., Windsor, Conn.

[21] Appl. No.: 328,179

[22] Filed: Dec. 7, 1981

[51] Int. Cl.[3] ..... E04B 1/38

[52] U.S. Cl. ..... 52/714; 52/350; 52/360; 52/489; 52/715; 122/6 A; 122/510; 403/387

[58] Field of Search ..... 122/6 A, 510; 403/387, 403/389, 391; 52/350, 488, 489, 714, 665, 370, 360, 346; 24/222, 224, 163 K

[56] References Cited

U.S. PATENT DOCUMENTS

| | | | |
|---|---|---|---|
| 1,248,440 | 12/1917 | Bauch | 52/370 X |
| 4,059,075 | 11/1977 | Ssinegurski et al. | 122/6 A |
| 4,240,234 | 12/1980 | Eisinger et al. | 52/261 |

*Primary Examiner*—Alfred C. Perham
*Assistant Examiner*—David J. Thomas
*Attorney, Agent, or Firm*—Edward L. Kochey, Jr.

[57] ABSTRACT

A buckstay stirrup for a steam generator is formed from a single plate, requiring only cutting and bending. The plate after cutting is bent to form two angled support portions (24) and a central portion (20). The outboard section (22) of the intermediate portion is cut (32) so that it extends inwardly to engage the inner edge of a buckstay, which is in the form of an I-beam. The central intermediate portion (20) is formed to be located inwardly of the outboard portion and contains an accordian fold (30) to permit the shortening which occurs during the bending. The two intermediate portions (20,22) are in parallel planes spaced to accept the buckstay flange therebetween.

3 Claims, 4 Drawing Figures

SINGLE PLATE BUCKSTAY STIRRUP

BACKGROUND OF THE INVENTION

This invention relates to steam generator structures and particularly to a single plate buckstay stirrup therefor.

Steam generators have rectangular furnaces or gas passes which are defined by walls formed of relatively small diameter tubes. The pressure within the steam generator furnace will be negative during operation of a balanced draft boiler and may have negative pressure excursions under certain operating conditions. The pressure within the steam generator will be positive when a pressure-fired unit is used and in any event may intermittently go positive on any steam generator. These variations in internal pressure cause the walls of the steam generator to buckle inwardly on negative pressure or tend to form a cylinder in the event of positive pressure. In order to maintain structural integrity, it is essential that these walls be maintained essentially flat.

This is accomplished by locating buckstays in the form of I-beams adjacent opposite walls of the furnace so that the buckstays can be attached to the furnace wall to maintain the adjacent wall in a flat condition. Since the furnace walls change in temperature from ambient to temperatures in the order of 300 C., while the buckstays are at ambient temperature at all times, it is essential that arrangements be made to permit appropriate expansion. This is accomplished by carrying the buckstays on the wall to permit the vertical expansion of the walls. The opposing buckstays are tied to one another through connections which are at the boiler wall temperature. This may be in the form of tie plates which are in close contact with the furnace walls and operate as tension members expanding with the furnace wall in connecting the opposing buckstays. The ends of the buckstays are connected by pinned connections at the corners, and the furnace wall is permitted to slide longitudinally of the buckstay with respect to the buckstay as it expands.

If the buckstays were maintained in close contact with the waterwalls, the internal flange of the buckstays would be heated greater then the outside flange thereby causing bowing of the buckstays. Accordingly, it is preferred to locate the buckstays a short distance from the furnace walls with insulation therebetween. Stirrups are used to make this connection between the furnace wall and the buckstay.

U.S. Pat. No. 4,059,075 illustrates such a buckstay stirrup. This buckstay stirrup may be connected to the furnace walls and operates to support the buckstay as well as to prevent relative inward or outward movement between the buckstay and the wall. With negative furnace pressure, the force will normally cause some inward bowing of the buckstay. In order that this does not bind the buckstay in the stirrup, thereby preventing the longitudinal relative expansion, the outer edge of the stirrup which engages the buckstay flange is slightly curved so that only line contact is made in this negative pressure condition. Binding is not significant in the event of positive pressure since this occurs only momentarily and differential expansion need not be permitted at that time.

The buckstay stirrup of U.S. Pat. No. 4,059,075 requires three separate pieces and welding therebetween.

A single large steam generator requires about 500 stirrups.

SUMMARY OF THE INVENTION

A buckstay stirrup capable of supporting the buckstay and interacting therewith in the event of both negative and positive pressures is formed from a single plate requiring only cutting and bending of the plate. The plate after cutting is bent so that two angled portions are formed which act as support members with these angled portions extending from the edge to bend lines. At the outboard ends of the plate, the angled portions extend a full-length to a bend line; but in the central portion they extend only part-length to a bend line. Outboard intermediate portions are parallel to the edges of the angled portions and join the full-length angled portions. A central intermediate portion joins the part-length angled portions and is shortened during bending from its original length. The outboard intermediate portions also extend inwardly beyond the area of junction with the angled portions so as to interface with the inside edge of a buckstay flange passed therebetween. The central and outboard intermediate portions are in parallel planes spaced from one another so that they accept the thickness of the flange in closely-spaced relationship. The outboard portions are spaced from one another at the junction with the angled portion sufficiently to accept the width of the flange of the buckstay therebetween.

The outboard intermediate portions are also centrally deformed toward the central intermediate portion so that they form only line contact with the buckstay flange passing through the stirrup. The central intermediate portion is preferably shortened with an accordian fold therein.

DESCRIPTION OF THE PREFERRED EMBODIMENT

Figure 1:
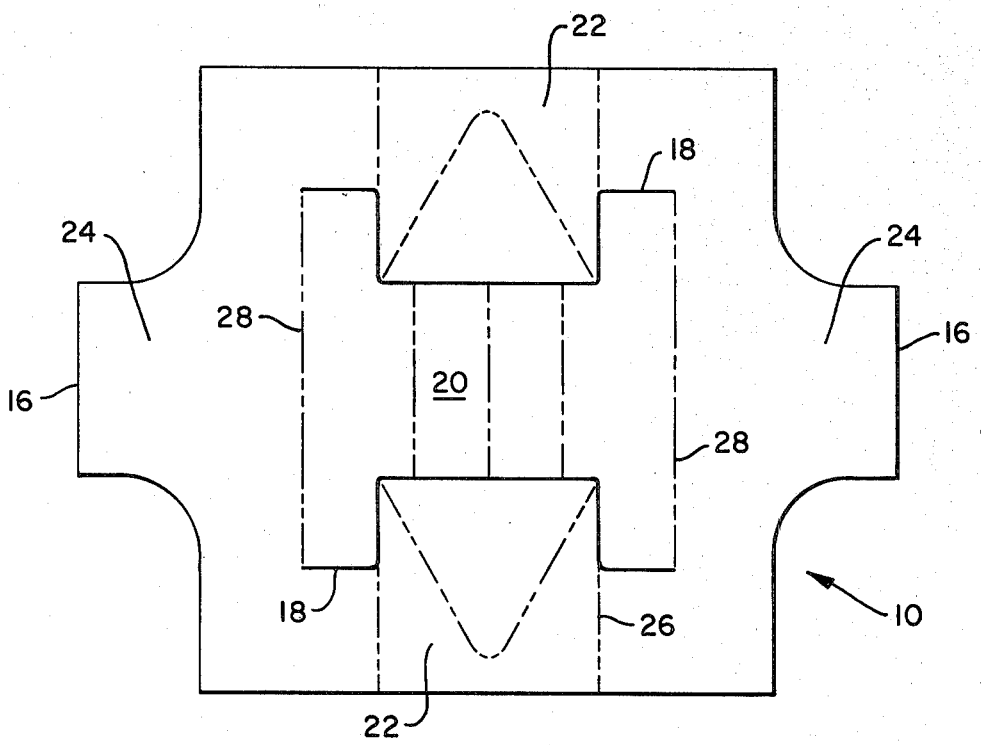
FIG. 1 is a lay out of the buckstay stirrup in a flat plate.

The buckstay stirrup is to be formed from the single plate 10 shown in its flat condition in FIG. 1. It is intended to be welded to the tension tie channel 12 of FIG. 4 which has earlier been welded to steam generator tubes 14.

Figure 2:
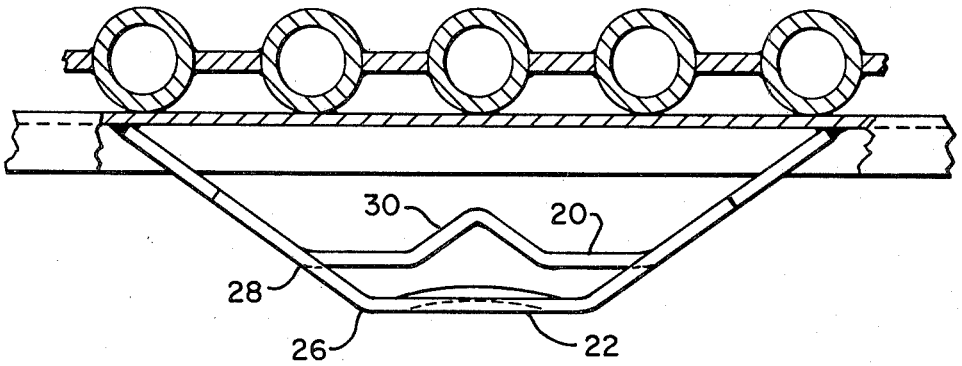
FIG. 2 is a plan view of the formed stirrup.
Figure 3:
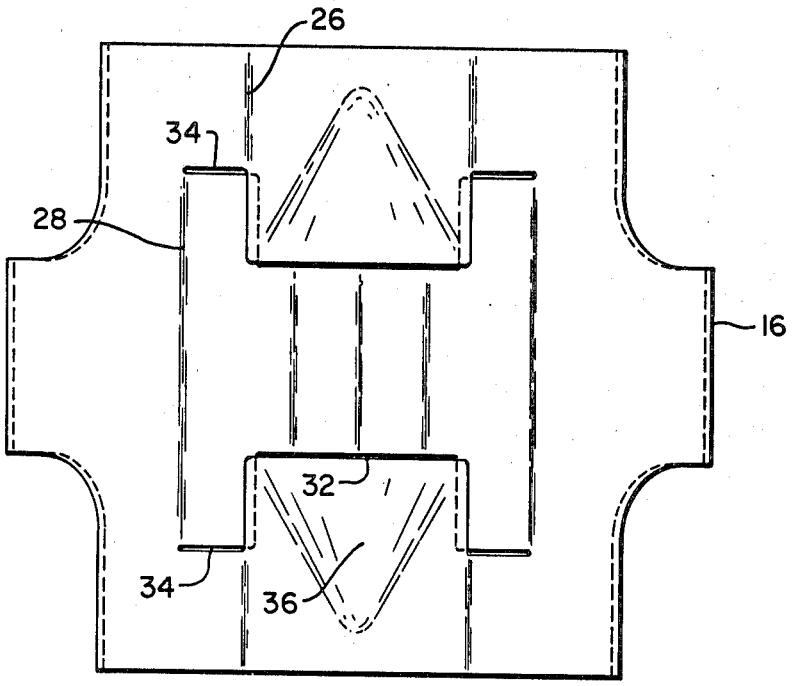
FIG. 3 is an elevation view of the formed stirrup.

Accordingly, the outer edges 16 of the plate are cut to a width suitable for fitting within the channel 12 for welding thereto. A cut line 18 permits differential bending of the intermediate portions of the plate. This cut divides the intermediate portion of the plate into a central portion 20 and two outboard portions 22. The dimensions in the flat plate lay out are, of course, selected in order to provide those that are desired in the forward stirrup as illustrated in FIGS. 2 and 3.

The angled portions 24 are selected to be bent on an angle perhaps 35 degrees from the flat plate. The angled portion 24 extends a full-length to bend line 26 outboard of the central portion 20 and extends part-length to bend line 28 of the central portion. The central portion 20 of the intermediate portion includes an accordion bend 30 which accepts the shortening of the central portion relative to the outboard portions during the bending operation. The central portion 20 and the outboard portion 22 are in parallel planes spaced from one another sufficient to accept the flange of a buckstay, which is in the form of an I-beam therebetween.

The outboard portion 22 extends inwardly to cut line 32 sufficiently to securely engage the inner surfaces of the buckstay flange. Cut lines 34 are spaced from one another sufficiently to accept the width of the flange of the buckstay (plus 2 cm.). The outboard intermediate portion 22 includes a bump 36 whereby it is centrally deformed toward the central intermediate portion. It is this bump which actually contacts the inner surface of the flange of the buckstay thereby permitting only line contact between the buckstay stirrup and the inner flange of the buckstay. This precludes binding between the buckstay and the stirrup on inward movement of the furnace wall.

While the cut lines must be placed at locations such that the buckstay will fit within the stirrup, the remaining material left must, of course, be selected in accordance with the forces anticipated to be placed on the stirrup.

The buckstay stirrup is formed from a single plate with only cutting and bending, and no welding required. The stirrup fulfills all of the functions required: carrying the buckstay and transmitting forces in both the inward and outward direction. Depending on machinery available and the thickness of plate used, it may be punched in a single operation; or since it is a symmetrical design, it may be punched in two or four consecutive operations. Where the thickness of the plate exceeds the capability of the punching apparatus, it may be cut by burning and thereafter bent as described.

Figure 4:
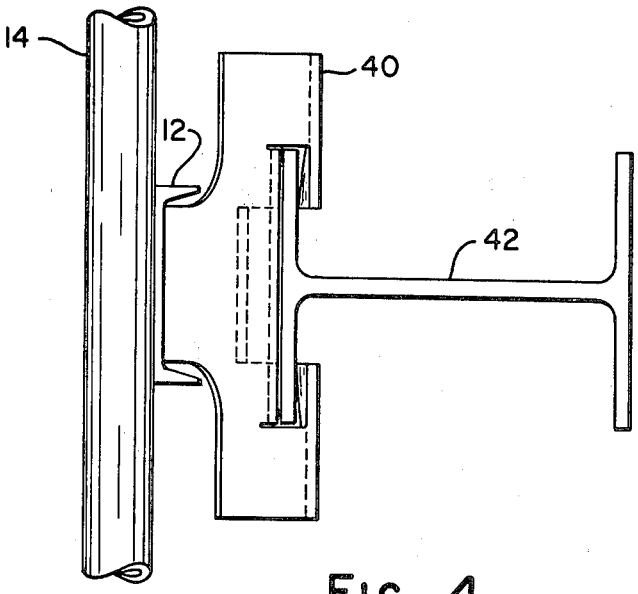
FIG. 4 illustrates the stirrup used in conjunction with a buckstay.

FIG. 4 illustrates the buckstay stirrup 40 as installed on steam generator tubes 14 carrying a typical buckstay 42.

I claim:

1. A single plate buckstay stirrup for a steam generator comprising: two angled portions of said plate each extending from opposite edges of the plate to bend lines including a full-length portion outboard of the center extending to a bend line, and a part-length portion in the center extending to a bend line; outboard intermediate portions parallel to the edges of the angled portions and joining said full-length angled portions outboard of the center; a central intermediate portion joining said part-length angled portions and shortened from its original length prior to bending of the single plate; said outboard intermediate portions extending inwardly beyond the area of junction with said angled portion; said central and outboard intermediate portions in parallel planes spaced from one another, sufficient to accept the thickness of the flange of a buckstay therebetween; and said outboard portions spaced from one another at the junction with said angled portion sufficient to accept the width of the flange of a buckstay therebetween.

2. A stirrup as in claim 1 also having said outboard intermediate portions centrally deformed toward said central portion where they are extended inwardly whereby only line contact is made with a buckstay flange passing through the stirrup.

3. A stirrup as in claim 1 or 2 wherein said central intermediate portion is shortened by passing an accordion fold therein.

* * * * *